US007085197B1

(12) United States Patent
Pehrson

(10) Patent No.: US 7,085,197 B1
(45) Date of Patent: Aug. 1, 2006

(54) TACTILE REMINDER DEVICE

(76) Inventor: Jacqueline Victoria Pehrson, 72 1/2 Plain Rd., Westford, MA (US) 01886

( * ) Notice: Subject to any disclaimer, the term of this patent is extended or adjusted under 35 U.S.C. 154(b) by 0 days.

(21) Appl. No.: 10/056,535

(22) Filed: Jan. 23, 2002

(51) Int. Cl.

| | |
|---|---|
| ***G04F 8/00*** | (2006.01) |
| ***G04F 10/00*** | (2006.01) |
| ***G04B 19/06*** | (2006.01) |
| ***G04B 25/02*** | (2006.01) |

(52) U.S. Cl. ..... 368/109; 368/230; 368/309

(58) Field of Classification Search ..... 368/71–74, 368/107–109, 230, 244, 250, 309
See application file for complete search history.

(56) References Cited

U.S. PATENT DOCUMENTS 3,438,195 A * 4/1969 Cochin ..... 368/230
5,365,497 A * 11/1994 Born ..... 368/230
5,559,761 A * 9/1996 Frenkel et al. ..... 368/69

* cited by examiner

*Primary Examiner*—Vit W. Miska

(57) ABSTRACT

The present invention essentially comprises a housing, a watch display contained within the housing and visible from the front of the housing, a vibrating mechanism contained within the housing and a vibration interval selection dial rotatably connected to the back of the housing. The vibration interval selection dial is electrically connected to the vibrating mechanism for selecting the time interval of the tactile reminder.

20 Claims, 3 Drawing Sheets

TACTILE REMINDER DEVICE

BACKGROUND OF THE INVENTION

1. Field of the Invention

The present invention relates to a tactile reminder device for use in connection with vibrating wrist watches. The tactile reminder device has particular utility in connection with vibrating wrist watches used as reminder devices for individuals suffering from Attention Deficit Hyperactivity Disorder (ADHD) and Attention Deficit Disorder (ADD).

2. Description of the Prior Art

Tactile reminder devices are desirable for quietly calling the attention of an individual to focus upon the completion of a task. Those individuals suffering from ADHD and ADD have difficulty with concentrating on a task to completion, tactile reminder devices gently remind the individual to refocus and stay on task. Tactile reminder devices allow this refocusing to be done silently without drawing the attention of those around the individual, thus allowing him to more easily integrate into his surrounding environment.

The use of vibrating wrist watches is known in the prior art U.S. Pat. No. 5,861,797 to Becker discloses a tactile reminder device that has a case which holds a microprocessor, a tactile alarm, an electric clock and a battery. The tactile device has a display that displays a message such as pay attention. However, the Becker '797 patent does not conceal the vibration interval dial to maintain the appearance of a common watch.

Similarly, U.S. Pat. No. 5,361,541 to Ferrara et al discloses a vibrating wristwatch that alerts the wearer by vibrating the entire wristband. However, the Ferrara et al '541 patent does not have nor conceal the vibration interval dial to maintain the appearance of a common watch.

U.S. Pat. No. 5,023,853 to Kawata et al discloses an electric apparatus with silent alarm that uses an ultrasonic wave motor and an eccentric weight to cause the vibration at alarm time to let a person know the alarm time. However, the Kawata et al '853 patent does not have nor conceal the vibration interval dial to maintain the appearance of a common watch.

Lastly, U.S. Pat. No. Des 381,588 to Weston discloses a design for a vibrating watch. However, the Weston '588 patent does not have nor conceal the vibration interval dial to maintain the appearance of a common watch.

While the above-described devices fulfill their respective, particular objectives and requirements, the aforementioned patents do not describe a tactile reminder device that allows vibrating wrist watches used as reminder devices for individuals suffering from Attention Deficit Hyperactivity Disorder (ADHD) and Attention Deficit Disorder (ADD). The Becker '797, Ferrara et al '541, Kawata et al '853 and Weston '588 patents makes no provision for conceal the vibration interval dial to maintain the appearance of a common watch.

Therefore, a need exists for a new and improved tactile reminder device which can be used for vibrating wrist watches used as reminder devices for individuals suffering from Attention Deficit Hyperactivity Disorder (ADHD) and Attention Deficit Disorder (ADD). In this regard, the present invention substantially fulfills this need. In this respect, the tactile reminder device according to the present invention substantially departs from the conventional concepts and designs of the prior art, and in doing so provides an apparatus primarily developed for the purpose of vibrating wrist watches used as reminder devices for individuals suffering from Attention Deficit Hyperactivity Disorder (ADHD) and Attention Deficit Disorder (ADD).

SUMMARY OF THE INVENTION

In view of the foregoing disadvantages inherent in the known types of vibrating wrist watches now present in the prior art, the present invention provides an improved tactile reminder device, and overcomes the above-mentioned disadvantages and drawbacks of the prior art. As such, the general purpose of the present invention, which will be described subsequently in greater detail, is to provide a new and improved tactile reminder device and method which has all the advantages of the prior art mentioned heretofore and many novel features that result in a tactile reminder device which is not anticipated, rendered obvious, suggested, or even implied by the prior art, either alone or in any combination thereof.

To attain this, the present invention essentially comprises a housing, a watch display contained within the housing and visible from the front of the housing, a vibrating mechanism contained within the housing and a vibration interval selection dial rotatably connected to the back of the housing. The vibration interval selection dial is electrically connected to the vibrating mechanism for selecting the time interval of the tactile reminder.

There has thus been outlined, rather broadly, the more important features of the invention in order that the detailed description thereof that follows may be better understood and in order that the present contribution to the art may be better appreciated.

The invention may also include a start button for initiating the tactile reminder sequence, a reset button for resetting the tactile reminder, a stop button for ending the tactile reminder sequence and a stop button cover to prevent the reminder sequence from being accidentally turned off. There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved tactile reminder device that has all of the advantages of the prior art vibrating wrist watches and none of the disadvantages.

It is another object of the present invention to provide a new and improved tactile reminder device that may be easily and efficiently manufactured and marketed.

An even further object of the present invention is to provide a new and improved tactile reminder device that has a low cost of manufacture with regard to both materials and labor, and which accordingly is then susceptible of low prices of sale to the consuming public, thereby making such tactile reminder device economically available to the buying public.

Still another object of the present invention is to provide a new tactile reminder device that provides in the apparatuses and methods of the prior art some of the advantages thereof, while simultaneously overcoming some of the disadvantages normally associated therewith.

Even still another object of the present invention is to provide a tactile reminder device for vibrating wrist watches used as reminder devices for individuals suffering from Attention Deficit Hyperactivity Disorder (ADHD) and Attention Deficit Disorder (ADD).

Still yet another object of the present invention is to provide a tactile reminder device for vibrating wrist watches used as reminder devices for individuals suffering from Attention Deficit Hyperactivity Disorder (ADHD) and Attention Deficit Disorder (ADD) in which the vibration interval dial is concealed to maintain the appearance of a common wristwatch.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
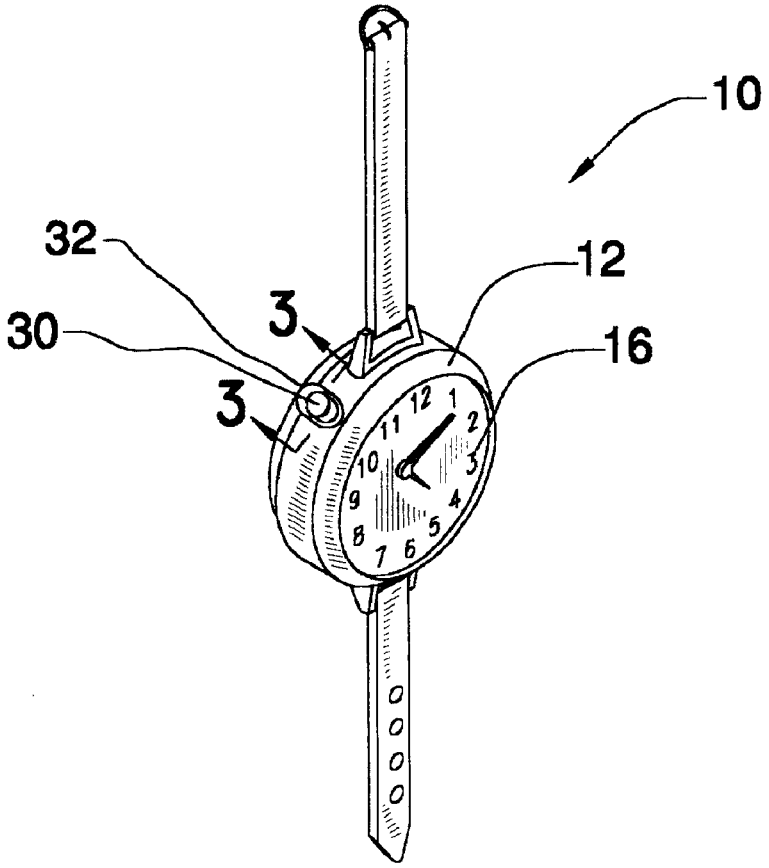
FIG. 1 is a front perspective view of the preferred embodiment of the tactile reminder device constructed in accordance with the principles of the present invention.

Referring now to the drawings, and particularly to FIGS. 1–5, a preferred embodiment of the tactile reminder device of the present invention is shown and generally designated by the reference numeral 10.

In FIG. 1, a new and improved tactile reminder device 10 of the present invention for use as reminder devices for individuals suffering from Attention Deficit Hyperactivity Disorder (ADHD) and Attention Deficit Disorder (ADD) is illustrated and will be described. More particularly, the tactile reminder device 10 has a housing 12, a watch display 16 contained within the housing and visible from the front of the housing, a stop button 30 on the housing, and a stop button cover 32 on the housing for keeping the stop button from accidentally being pushed and deactivating the tactile reminder sequence. The present embodiment is made in the form of a wrist watch having a housing 12 and having the well known wrist band.

Figure 2:
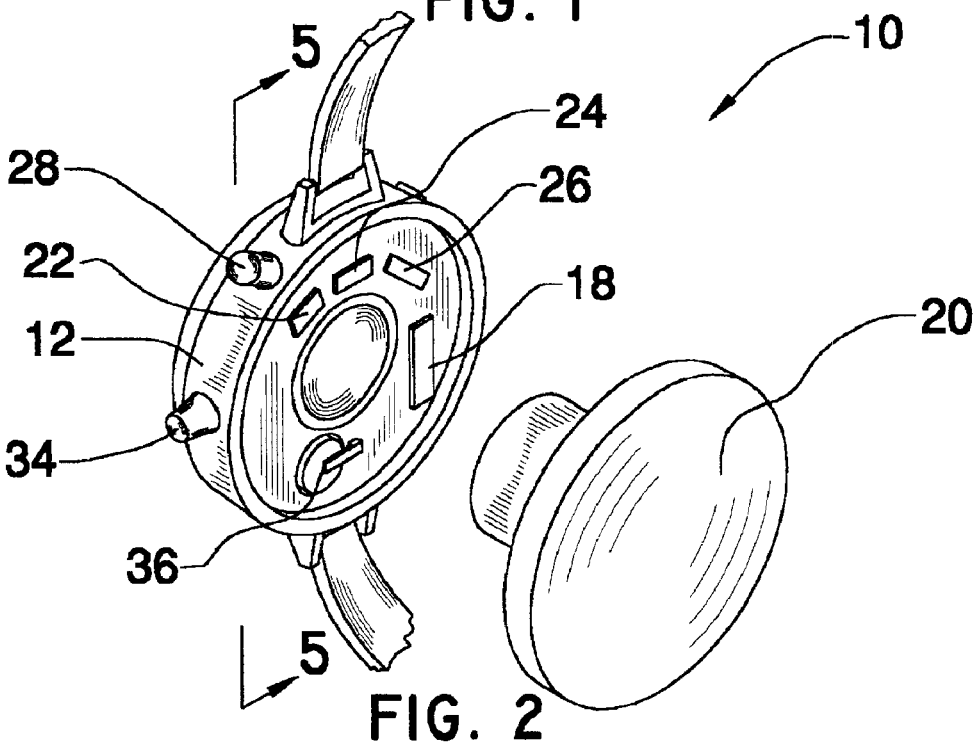
FIG. 2 is a rear perspective exploded view of the tactile reminder device of the present invention.
Figure 3:
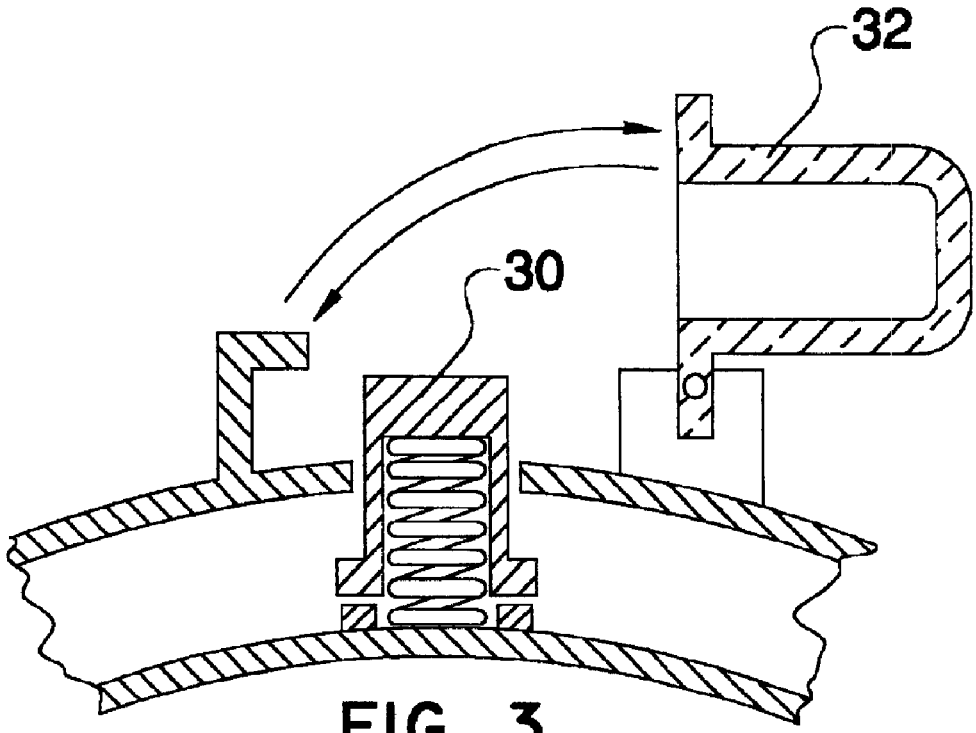
FIG. 3 is a section view 3—3 of FIG. 1 of the tactile reminder device of the present invention.

FIG. 2 of the present invention shows the device from the back in an exploded view. The tactile reminder device 10 has a vibrating mechanism 18 contained within the housing, a vibration interval selection dial 20 located on the back of the housing, a power source 36 contained within the housing, a three minute interval contact 22, a five minute interval contact 24 and a seven minute interval contact 26 electrically selectable by the vibration interval selection dial, a start button 28 on the housing, and a reset button 34 on the housing FIG. 3 of the present invention is a section view 3—3 of FIG. 1 which shows the stop button 30 with the hinged stop button cover 32 protecting it from accidental deactivation.

Figure 4:
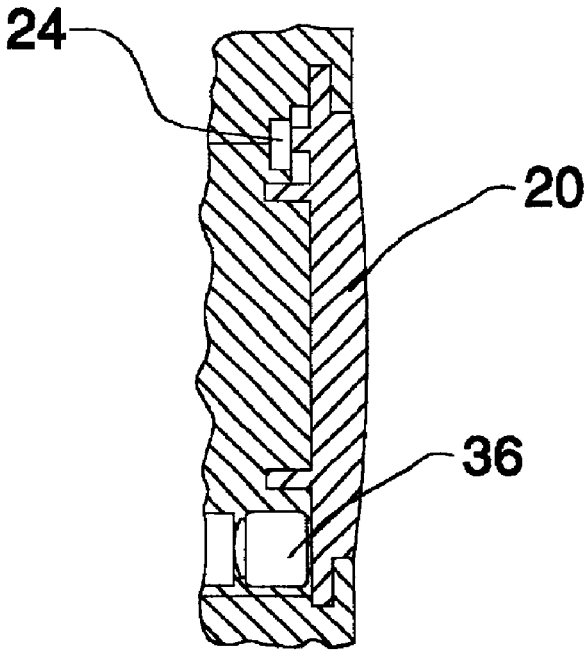
FIG. 4 is a block diagram view of the tactile reminder device of the present invention.

FIG. 4 of the present invention shows a block diagram of the electrical connections of the tactile reminder device 10. The three minute interval contact 22 is electrically connected to a microprocessor 14, the five minute interval contact 24 is electrically connected to the microprocessor 14, and the seven minute interval contact 26 electrically connected to the microprocessor 14. The power source 36 is connected to the microprocessor 14. The stop button 30 is electrically connected to the microprocessor for deactivating the tactile reminder sequence. The start button 28 is electrically connected to the microprocessor 14 for activating the tactile reminder sequence. The watch display 16 is electrically connected to the microprocessor for displaying the time. The vibrating mechanism 18 is electrically connected to the microprocessor for giving the tactile reminder.

Figure 5:
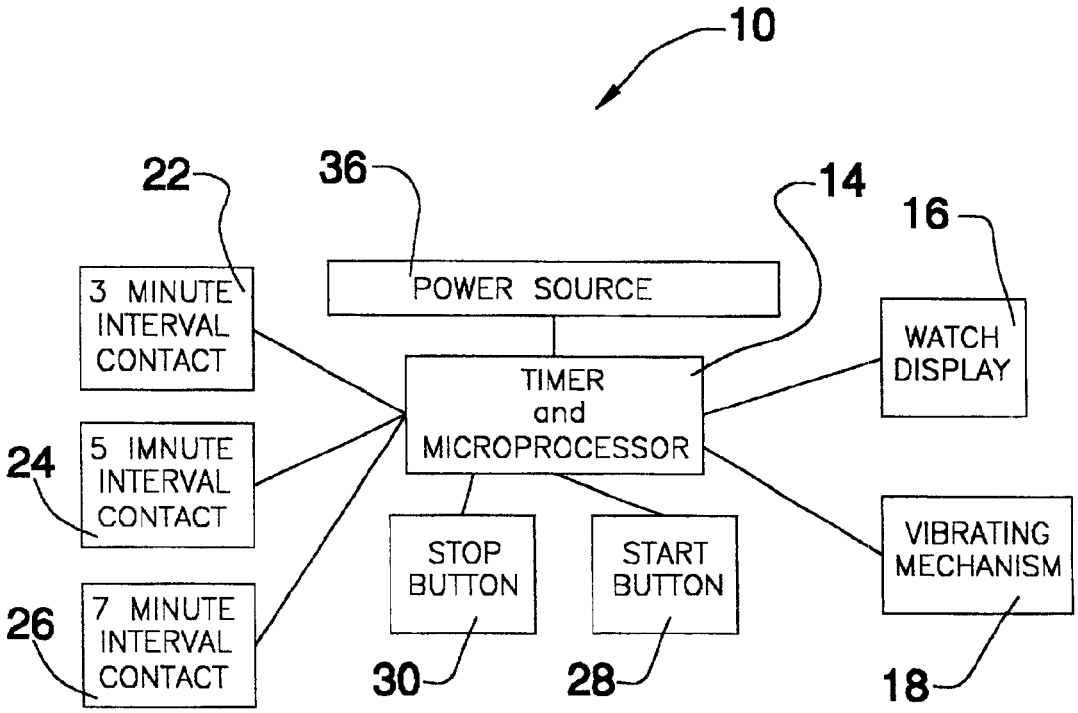
FIG. 5 is a section view 5—5 of FIG. 2 of the tactile reminder device of the present invention.

FIG. 5 of the present invention shows the section 5—5 of FIG. 2. The vibration interval selection dial 20 electrically connects the power source 36 with either the three minute interval contact 22, the five minute interval contact 24 or the seven minute interval contact 26 to electrically select it.

In use, it can now be understood that the tactile reminder interval is chosen by turning the vibration interval selection dial 20 to the chosen interval and initiating the sequence by pressing the start button 28. When the tactile reminder occurs and the individual wants to stop the vibration, but continue the sequence the reset button 34 is pushed. When the individual wants to the tactile reminder sequence he flips up the stop button cover 32 and presses the stop button 30.

While a preferred embodiment of the tactile reminder device has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as stainless steel or aluminum may be used instead of the high impact plastic described. Also, the watch may have a digital readout instead of the analog readout described, and the wrist watch may be made to be appropriate for a man or a woman. And although vibrating wrist watches used as reminder devices for individuals suffering from Attention Deficit Hyperactivity Disorder (ADHD) and Attention Deficit Disorder (ADD) have been described, it should be appreciated that the tactile reminder device herein described is also suitable for reminding any individual to stay on task at regular intervals.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A tactile reminder device comprising:

a housing;

a watch display contained within said housing and visible from the front of said housing;

a vibrating mechanism contained within said housing; and a vibration interval selection dial rotatably connected to the back of said housing, said vibration interval selection dial electrically connected to said vibrating mechanism for selecting the time interval of said tactile reminder.

2. The tactile reminder device of claim 1 further comprising:

a microprocessor contained within said housing, said microprocessor being electrically connected to said watch display and said vibrating mechanism for controlling said watch display and said vibrating mechanism.

3. The tactile reminder device of claim 1 further comprising:

a start button attached to said housing and electrically connected to said vibrating mechanism for activating the tactile reminder sequence.

4. The tactile reminder device of claim 1 further comprising:

a stop button attached to said housing and electrically connected to said vibrating mechanism for deactivating the tactile reminder sequence.

5. The tactile reminder device of claim 4 further comprising:

a stop button cover hingedly attached to said housing for keeping the stop button from accidentally being pushed and deactivating the tactile reminder sequence.

6. The tactile reminder device of claim 1 further comprising:

a three minute interval contact attached to said housing and electrically selectable by said vibration interval selection dial;

a five minute interval contact attached to said housing and electrically selectable by said vibration interval selection dial; and a seven minute interval contact attached to said housing and electrically selectable by said vibration interval selection dial.

7. The tactile reminder device of claim 1 further comprising:

a reset button attached to said housing and electrically connected to said vibrating mechanism for deactivating the tactile reminder sequence.

8. The tactile reminder device of claim 1 wherein said watch display is analog.

9. The tactile reminder device of claim 1 wherein said watch display is digital.

10. A tactile reminder device comprising:

a housing;

a microprocessor contained within said housing;

a watch display electrically connected to said microprocessor, said watch display contained within said housing and said watch display visible from the front of said housing;

a vibrating mechanism electrically connected to said microprocessor and contained within said housing; and a vibration interval selection dial rotatably connected to the back of said housing, said vibration interval selection dial electrically connected to said microprocessor for selecting the time interval of said tactile reminder.

11. The tactile reminder device of claim 10 further comprising:

a start button attached to said housing and electrically connected to said vibrating mechanism for activating the tactile reminder sequence.

12. The tactile reminder device of claim 10 further comprising:

a stop button attached to said housing and electrically connected to said vibrating mechanism for deactivating the tactile reminder sequence.

13. The tactile reminder device of claim 12 further comprising:

a stop button cover attached to said housing for keeping the stop button from accidentally being pushed and deactivating the tactile reminder sequence.

14. The tactile reminder device of claim 10 further comprising:

a three minute interval contact attached to said housing and electrically selectable by said vibration interval selection dial;

a five minute interval contact attached to said housing and electrically selectable by said vibration interval selection dial; and a seven minute interval contact attached to said housing and electrically selectable by said vibration interval selection dial.

15. The tactile reminder device of claim 10 further comprising:

a reset button attached to said housing and electrically connected to said vibrating mechanism for deactivating the tactile reminder sequence.

16. A tactile reminder device comprising:

a housing;

a microprocessor contained within said housing;

a watch display electrically connected to said microprocessor, said watch display contained within said housing and said watch display visible from the front of said housing;

a vibrating mechanism electrically connected to said microprocessor and contained within said housing;

a vibration interval selection dial rotatably connected to the back of said housing, said vibration interval selection dial electrically connected to said microprocessor for selecting the time interval of said tactile reminder;

a three minute interval contact attached to said housing and electrically selectable by said vibration interval selection dial;

a five minute interval contact attached to said housing and electrically selectable by said vibration interval selection dial; and a seven minute interval contact attached to said housing and electrically selectable by said vibration interval selection dial.

17. The tactile reminder device of claim 16 further comprising:

a start button attached to said housing and electrically connected to said vibrating mechanism for activating the tactile reminder sequence.

18. The tactile reminder device of claim 16 further comprising:

a stop button attached to said housing and electrically connected to said vibrating mechanism for deactivating the tactile reminder sequence.

19. The tactile reminder device of claim 18 further comprising:

a stop button cover rotatably connected to said housing for keeping the stop button from accidentally being pushed and deactivating the tactile reminder sequence.

20. The tactile reminder device of claim 16 further comprising:

a reset button attached to said housing and electrically connected to said vibrating mechanism for deactivating the tactile reminder sequence.

* * * * *